US005641953A

United States Patent [19]

Fisher, Jr.

[11] Patent Number: 5,641,953

[45] Date of Patent: Jun. 24, 1997

[54] SAFETY INTERLOCK SYSTEM FOR TELECOMMUNICATION AMPLIFIERS

[75] Inventor: Lawrence R. Fisher, Jr., Bellefonte, Pa.

[73] Assignee: C-Cor Electronics, Inc., State College, Pa.

[21] Appl. No.: 407,579

[22] Filed: Mar. 20, 1995

[51] Int. Cl.[6] ..... H01H 9/22

[52] U.S. Cl. ..... 200/50.12

[58] Field of Search ..... 200/50 R–50 C, 200/50.01–50.2, 50.28–50.31

[56] References Cited

U.S. PATENT DOCUMENTS

| | | | |
|---|---|---|---|
| 2,342,852 | 2/1944 | Frank | 200/50 |
| 3,534,186 | 10/1970 | Meyer | 200/50 |
| 3,846,703 | 11/1974 | Stewart et al. | 325/53 |
| 4,073,000 | 2/1978 | Krejsa | 361/344 |
| 4,652,769 | 3/1987 | Smith et al. | 307/31 |
| 4,659,884 | 4/1987 | Wollenkaupt | 200/50 R |
| 4,885,436 | 12/1989 | Pham et al. | 200/50 A |
| 4,931,907 | 6/1990 | Robinson et al. | 361/391 |
| 5,289,347 | 2/1994 | McCarthy et al. | 361/809 |

*Primary Examiner*—Michael L. Gellner
*Assistant Examiner*—Michael A. Friedhofer
*Attorney, Agent, or Firm*—Price & Adams

[57] ABSTRACT

AC power at 15 amps and a radio frequency signal are transmitted in a coaxial cable to a telecommunications amplifier. The AC signal is separated from the RF signal by a radio frequency module. The AC signal is converted to a regulated DC voltage for supplying power to condition and amplify the radio frequency signal transmitted from the amplifier. A power supply module in the amplifier is connected through a bank of fuses and a power switch to the RF module. A cover plate overlies the fuses and the electrical connection between the power supply module and the RF module. The power switch includes a toggle lever movable between power on and power off positions to transmit power between the modules. To prevent exposure of operating personnel and the electrical equipment to the hazards of high voltage and electric shock, the toggle switch obstructs movement of the cover plate exposing the fuses in a power on position. The toggle switch must be pivoted to the power off position before the cover plate can be moved to allow access to the fuses and the line voltage test points. Retaining screws and hold-down screws lock the cover plate in the power on position.

20 Claims, 5 Drawing Sheets

SAFETY INTERLOCK SYSTEM FOR TELECOMMUNICATION AMPLIFIERS

BACKGROUND OF THE INVENTION

1. Field of the Invention

This invention relates to method and apparatus for interlocking access to a source of power of an amplifier with the position of a power switch requiring the switch to be retained in a power off position to permit access to the power supply or line voltage test points and, more particularly, to a cover plate slidably retained in an amplifier housing in overlying relation with the power switch and movable between a power on position and a power off position to prevent exposure to the hazards of electrical shock.

2. Description of the Prior Art

In the transmission of cable television signals and data transmission signals through coaxial cables a broadband radio frequency signal transmitted between 5–400 MHz is transmitted with a power signal at 30–60 VAC at 60 Hz. The AC power signal supplies power to the amplifiers positioned at selected points in the cable transmission line for amplifying and conditioning the broadband radio frequency signal.

The amplifiers are sealed units formed by a die-cast aluminum alloy housing having a hinged base cover. A radio frequency module and a power supply module are retained in the housing which protects the components from the affects of weather and hermetically seals the electrical components to prohibit entrance of contaminants into the housing. The housing is connected to a number of input and output transmission cables. The amplifier housing is adapted for mounting on a wall or pedestal by the use of external brackets connected to the housing. Strand clamps are connected to the housing to mount the housing to a power line or similar strand.

With the conventional transmission of cable television signals, the power signal is transmitted at a current in the range between about 10 to 12 amps. Current at this level presents a relatively low shock hazard to operating personnel in the event that the plug-in fuses would be removed from the radio frequency module when the amplifier is being supplied with power. Also, in the event that the radio frequency module is disconnected from the power supply module when the modules are under load there is little or no risk to a shock hazard when the power supply signal does not exceed 12 amps.

With the development of telecommunication systems utilizing CATV transmission lines for connecting subscribers to a number of interactive units, the powering scheme used in conventional CATV systems is not acceptable. The interactive units connected to the cable transmission line require power supplied between 45 to 140 volts AC having a cycle rate of 1 Hz. The amperage for the power signal is at least 15 amps which presents a substantially greater shock hazard to operating personnel than experienced with conventional CATV systems where the power signal does not exceed 12 amps.

In a telecommunications amplifier supplied with a power signal of 15 amps precautions must be taken to prevent removal of the radio frequency module from the power supply module under load. At 15 amps the connectors interfacing the two modules can be damaged when the modules are disconnected under load. The power signal is supplied to the radio frequency module through fuses. The fuses are held in place by clips, and if the fuses are removed under load the operator is exposed to hazardous voltage levels. In addition, precaution must be taken to prevent the removal of the radio frequency module from the amplifier housing when the power is supplied to the module.

Safety interlock systems for preventing access to electrical equipment that presents hazardous exposure to high voltage are known in the art. Protective equipment is positioned during dangerous operating conditions to prevent exposure to high voltages. When the dangerous condition is removed, such as removing the supply of power to electrical apparatus, the protective equipment can be opened or removed.

An example of a safety interlock system for electrical apparatus is disclosed in U.S. Pat. No. 4,659,884. The interlock system includes a sliding door interlocked by a bolt or a slide which is actuated by a magnet and is kept under current in a locked position. A locking lever and an actuating part are brought into engagement with each other by a sliding protective hood causing positioning of the toggle lever within a housing in a closed interlocked condition. In the closed condition current is supplied to the machine. In a second or open position of the lever supply of current to the machine is interrupted.

U.S. Pat. No. 4,652,769 discloses a safety interlock system for a multielectrode device, such as an ion source. The interlock system disconnects high voltage supply without removing low power logic signals to allow the system to continue to operate in various modes so that high voltage can be reinstalled safely upon the reinsertion of a module or upon restoration of an interrupt condition.

In U.S. Pat. No. 4,073,000 a metal-enclosed switchgear includes a door that opens into a switch housing. As long as the door is closed electrical current may be supplied to the components within the enclosure interconnected to the contacts of a switch. When the doors open the switch contacts are opened thereby opening the circuit to permit operating personnel to perform service on the components without risk of electrical shock. As long as the door is closed operating personnel cannot gain access to the components.

U.S. Pat. No. 3,534,186 discloses a control cabinet for an electrical power supply connected to a circuit breaker. The circuit breaker is interlocked with the access doors of the cabinet. The circuit breaker is actuated when anyone of the access doors is open.

A further example of an interlock system for electrically and mechanically operated equipment is disclosed in U.S. Pat. No. 4,931,907 in which a latch in a module engages a keeper on a housing and a switch pin is mounted in the latch handle to engage a lever which in turn engages the keeper mounted on the housing. As long as the lever engages the keeper the module is electrically connected to the housing. Movement of the module out of the housing releases the lever arm from the keeper to release an enable switch which electrically isolates the module from the housing.

U.S. Pat. No. 4,885,436 discloses a switch interlock for an electronic module which permits connection and disconnection of electrical connectors only when the main power switch is off. A switch guard is positioned over a toggle-type power switch and slides over the power switch when the power switch is off. A cut-away portion of the switch guard is blocked from upward movement by the button of the power switch when the switch is on.

U.S. Pat. No. 3,846,703 discloses a noise control system for transmission line amplifiers in a CATV system. Control units are manually actuated by switches. Opening a switch disconnects a return amplifier from its feeder cable and closing a switch connects it to an associated feeder cable.

While safety interlock systems for electrical apparatus are known to prevent operating personnel from being exposed to hazardous voltages, the known systems do not provide a solution to protect in a failsafe manner operating personnel from exposure to risk of electrical shock in the installation and maintenance of telecommunication amplifiers. Because transmission amplifiers are now being used to power a number of broadband network devices higher voltages are required to be supplied to the amplifiers. The amplifiers are readily assembled and disassembled in the telecommunication transmission lines. If precautions are not taken to prevent removal of the respective modules under load or preclude access to fuses under load, serious injury may be inflicted on operating personnel and damage incurred to the electrical components.

Therefore there is need in telecommunications amplifiers for a safety interlock system that prevents in a substantially failsafe method operating personnel from coming in contact with the electrical components under load and when the power is interrupted, power cannot be restored until hazardous voltage conditions are eliminated.

SUMMARY OF THE INVENTION

In accordance with the present invention there is provided an electrical interlock apparatus for a telecommunications amplifier that includes a housing forming an enclosed compartment. The housing has ports for attachment to electrical cables for receiving an AC power signal combined with a radio frequency signal. A radio frequency module is positioned in the housing for receiving the AC power signal and separating the AC power signal from the radio frequency signal. A power supply module is removably electrically connected to the radio frequency module in the housing for converting AC power to a regulated DC voltage to supply DC voltage for operation of the radio frequency module. A power switch is mounted on the radio frequency module for electrically connecting the radio frequency module to the AC power signal supplied to the housing. The power switch is movable between a closed position to transmit the AC power signal to the power supply module and an open position preventing the AC power signal from being received by the power supply module. A cover plate is slidably positioned on the radio frequency module overlying the connection of the power supply module to the radio frequency module. The cover plate has a slot for receiving the power switch. The power switch when in the closed position is retained in a first position in the slot to prevent sliding movement of the cover plate to fix the position of the cover plate on the radio frequency module preventing access to the electrical connection with the power supply module and removal of the power supply module when the power switch is in the closed position. The power switch when in the open position is retained in a second position in the slot allowing movement of the cover plate to a position on the radio frequency module permitting access to the electrical connection with the power supply module.

In addition, the present invention is directed to a safety interlock system for a telecommunications amplifier that includes a first module for receiving electrical power from a source and transmitting the electrical power. A second module receives the electrical power transmitted by the first module. An electrical circuit removably connects the first and second modules. An electrical switch is positioned in the circuit to open and close the circuit and control the electrical power transmitted by the first module to the second module. A toggle lever is connected to the switch for actuating the switch to open and close the circuit upon pivotal movement between power off and power on positions respectively. A cover plate is movably supported in overlying relation with the circuit connecting the first and second modules. The cover plate has an elongated slot for receiving the toggle lever. The cover plate is movable relative to the toggle lever positioned in the slot. The toggle lever when pivoted in the slot to the power on position obstructs movement of the cover plate to provide access to the circuit and prevent disconnection of the first and second modules when power is transmitted to the second module. The toggle lever when pivoted in the slot to the power off position allows movement of the cover plate to a position relative to the toggle lever to provide access for disconnecting the first and second modules while preventing movement of the toggle lever to the power on position.

Further in accordance with the present invention, there is provided a method for interlocking the movement of a power switch with the position of a protective cover for electrical apparatus comprising the steps of electrically connecting a first electrical device to a second electrical device in an electrical circuit. The electrical circuit between the first and second devices is opened and closed by a toggle switch. The toggle switch is moved between power on and power off positions to control the transmission of the electrical power between the first and second devices. A cover plate is positioned over the electrical connection between the first and second devices. The toggle switch obstructs movement of the cover plate in the power on position to prevent access to the electrical connection. The toggle switch permits movement of the cover plate in the power off position to expose the electrical connection and provide access to the first and second devices.

Accordingly, a principal object of the present invention is to provide method and apparatus for interlocking access to electrical components connected to a power supply so that access to the components is prevented when the power is supplied to the components and when the components are accessible power can not be accidentally supplied thereto.

Another object of the present invention is to provide a broadband network amplifier having a cover for preventing access to the DC power connection until the cover has moved to a position which prevents a toggle switch from being accidentally turned on exposing operating personnel to hazardous voltages.

A further object of the present invention is to provide a safety interlock overlying the connection between a radio frequency module and a power supply module in a telecommunications amplifier where the position of a toggle switch controlling the supply of power between the modules prevents access to the modules under load.

A further object of the present invention is to provide a slidable cover that overlies the electrical connection between a pair of modules in an amplifier where the position of the cover prevents a toggle switch from being moved to the on position when the electrical connection between the modules is exposed to prevent shock hazards.

These and other objects of the present invention will be more completely disclosed and described in the following specification, the accompanying drawings, and the appended claims.

DESCRIPTION OF THE PREFERRED EMBODIMENTS

Figure 1:
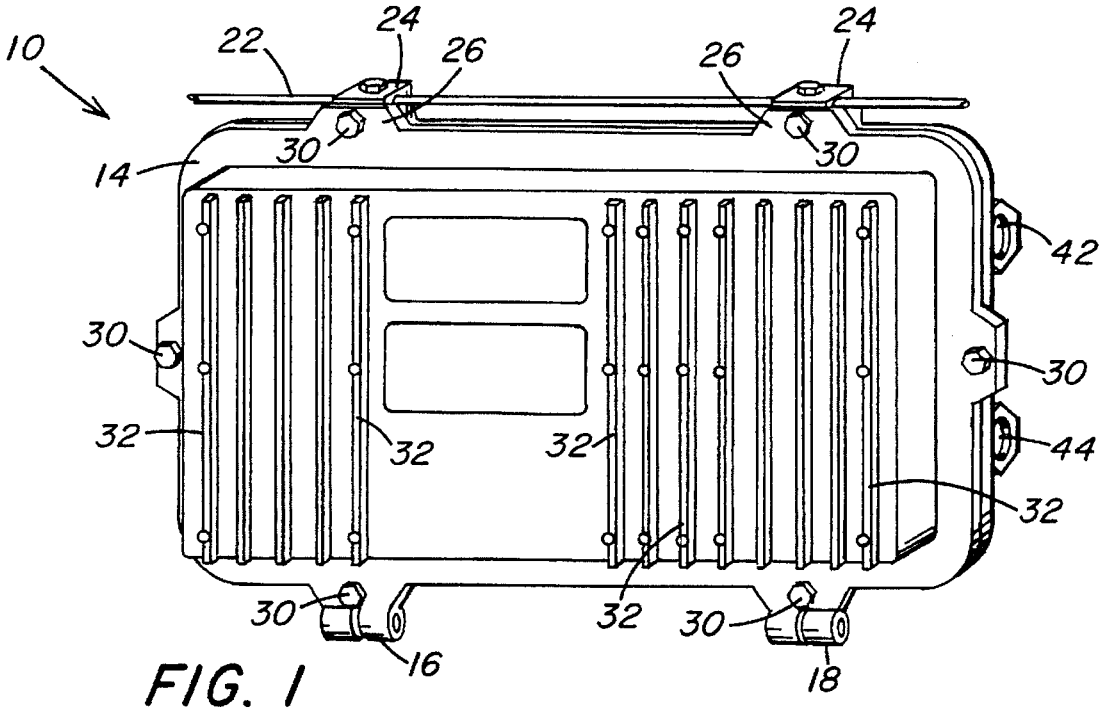
FIG. 1 is a front elevational view of a broadband network amplifier mounted on a strand in a telecommunications network and containing safety interlock apparatus in accordance with the present invention.

Referring to the drawings and particularly to FIGS. 1–6 there is illustrated a broadband network amplifier generally designated by the numeral 10 for transmitting a 60 Hz AC power signal combined with a radio frequency signal as commonly encountered in cable television transmissions. Typically, the cable signal is transmitted between about 5 to 400 MHz. The AC power signal is transmitted through the same cable that transmits the radio frequency signal. The AC signal powers the amplifiers in the cable transmission line. The amplifier 10 is representative of amplifiers particularly adapted for transmitting other telecommunications signals.

As known in the art a broadband signal amplifier uses broadband radio frequency chokes to separate the AC power signal from the low power radio frequency signal. The amplifier primarily provides amplification of the radio frequency signals returning to the headend or fiber node in the cable transmission line.

Radio frequency signals enter the amplifier 10 and receive adjustment for signal attenuation and cable slope compensation to establish unity gain. The amplifier 10 next performs preamplification and level control on the forward radio frequency signals. Level control may be either manual or automatic. The forward radio frequency signals are amplified to final output levels and directed toward output ports of the amplifier.

Reverse radio frequency signals also enter the amplifier from forward output ports and are directed on a path separate from the forward radio frequency signals. The forward radio frequency signals are transmitted at a higher frequency than the reverse radio frequency signals. The reverse radio frequency signals receive adjustment for signal attenuation and are then amplified. The amplified reverse radio frequency signals then receive adjustment for cable slope compensation. The compensated reverse radio frequency signals are then diplexed into the incoming forward radio frequency signal path and leave the amplifier via the input cable. The details for conditioning the forward and reverse radio frequency signals by the amplifier 10 are beyond the scope of the present invention and will not be discussed in detail.

Figure 2:
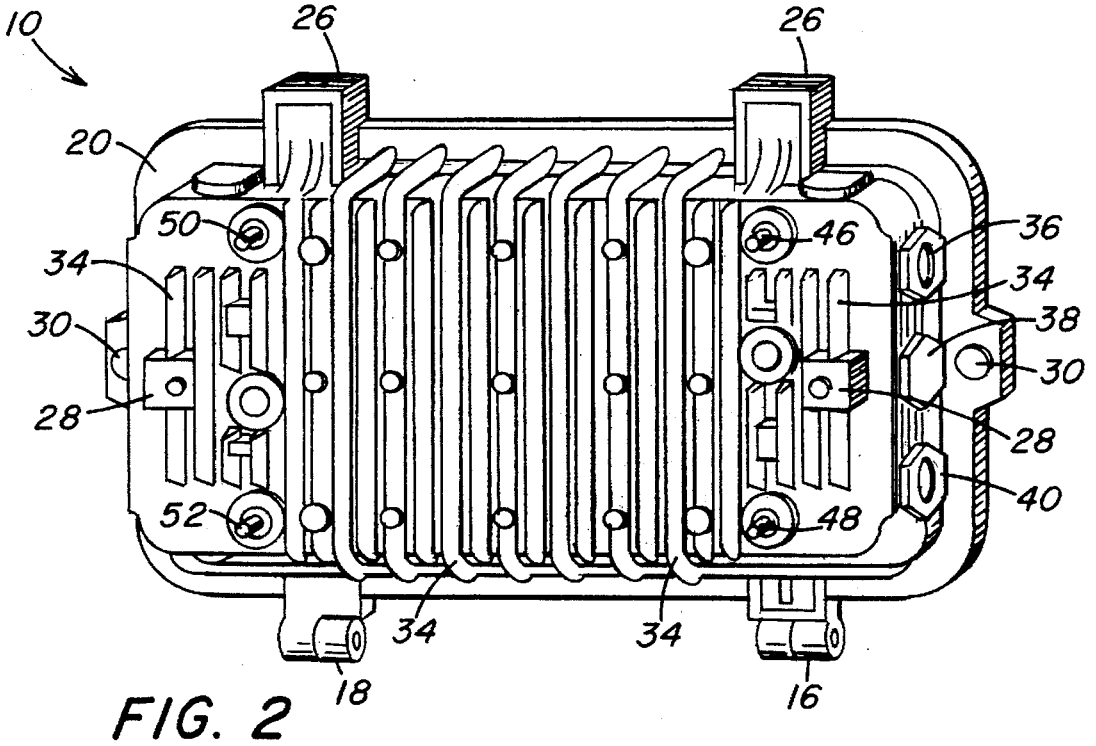
FIG. 2 is a rear elevational view of the amplifier shown in FIG. 1.
Figure 3:
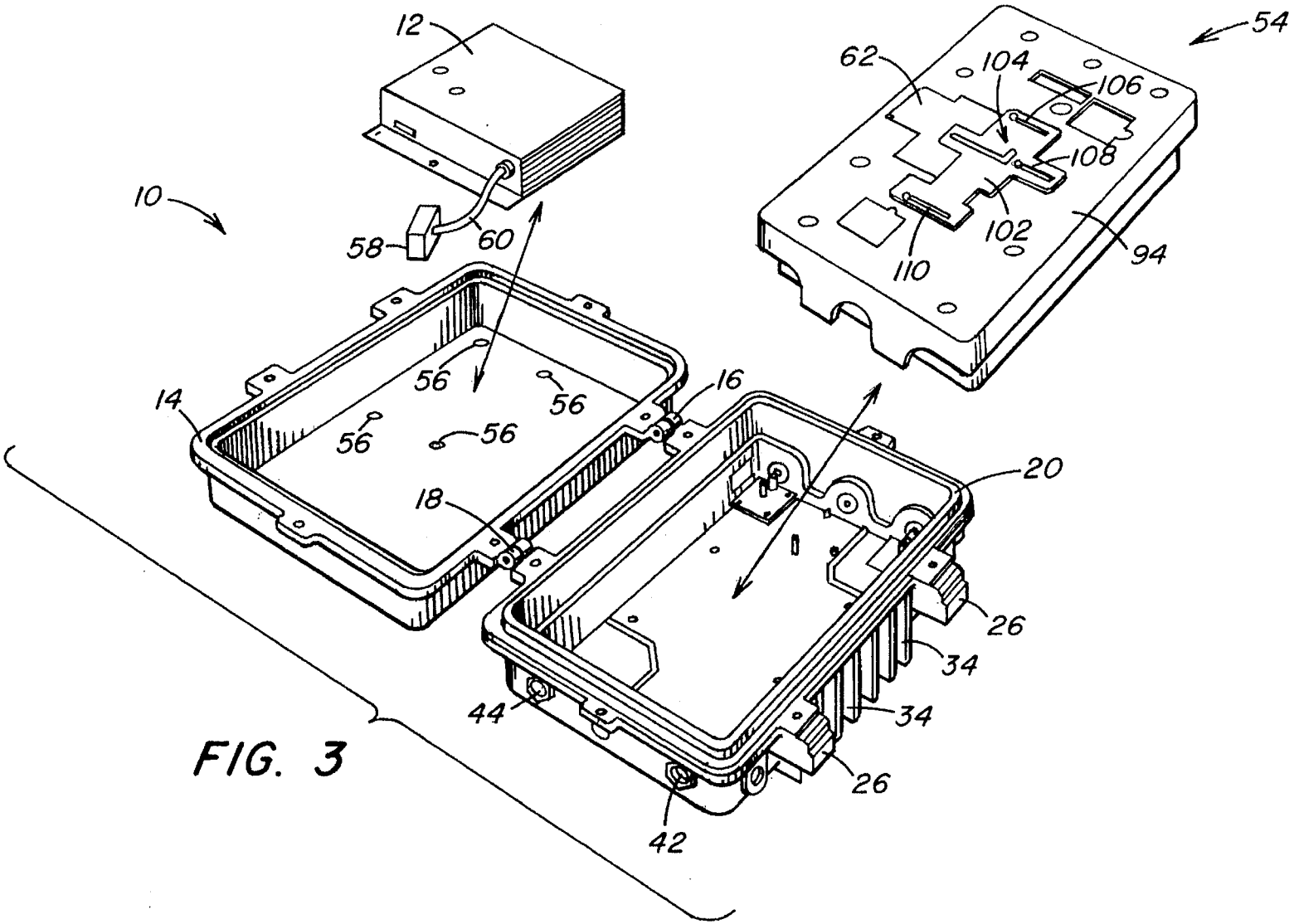
FIG. 3 is an exploded isometric view of the amplifier shown in FIGS. 1 and 2, illustrating a power supply module and a radio frequency module with the safety interlock system contained in the amplifier housing.

Power for the amplifier 10 is received from either cable input or output paths. A power supply module shown in FIG. 3 receives 90 VAC cable power and generates all required operating voltages. The amplifier 10 is operable to pass AC cable power at 15 amps in either direction to adjacent amplifiers. As seen in FIGS. 1–3, the amplifier 10 includes a housing cover 14 pivotally connected by hinges 16 and 18 to a housing base 20.

Preferably, the cover 14 and base 20 are fabricated of a die-cast aluminum alloy and adapted to be mounted on a strand 22, as shown in FIG. 1. The amplifier 10 is connected to the strand 22 associated with a cable transmission line by clamps 24 which are secured to bosses 26 on the housings 14 and 20. Mounting brackets (not shown) can also be connected to the bosses 26 for pedestal mounting of the amplifier 10. For wall mounting of the amplifier 10 the housing base 20 includes bosses 28 for receiving bolts.

Further as illustrated in FIGS. 1 and 2, the housing cover 14 is connected to the housing base 20 by a plurality of cover bolts 30. The cover 14 is also provided with a plurality of vertically extending, parallel spaced convection fins 32 to facilitate cooling of the metal housing. The housing base 20 as shown in FIG. 2 is also provided with convection fins 34.

The base 20 is provided with a plurality of cable input/output ports 36, 38, 40, 42 and 44. In addition, the housing base 20 includes a plurality of test point ports 46, 48, 50 and 52.

In one embodiment the port 36 is a forward signal input port or a reverse signal output port. Port 38 is an optional power insertion port. Port 40 is a forward signal output port or a reverse signal input port. Port 42 is a forward signal output port or a reverse signal input port. Port 44 is a forward signal output port or a reverse signal input port.

Test point port 46 is a forward signal input/reverse signal output test point. Test point port 48 is a forward signal output/reverse signal output test point. Test point port 50 is a forward signal output/reverse signal input test point. Test point port 52 is a forward signal output/reverse signal input test point.

The amplifier 10 provides a hermetically sealed compartment for the internal electrical components. Environmental protection is provided by a silicone rubber gasket (not shown) which serves to prevent the entrance of contaminants into the amplifier. In addition, the housing cover 14 and housing base 20 are sealed by the provision of a metal mesh gasket (not shown) which blocks radio frequency energy from entering or leaving the amplifier 10. The convection fins 32 and 34 promote heat transfer from the amplifier 10 to aid in cooling the electronic components. The external test points 46–52 provide for sampling input and output signals without requiring the housing 10 to be opened.

As illustrated in FIG. 3 the power supply module 12 and a radio frequency module generally designated by the numeral 54 are retained in the housing cover 14 and housing base 20 respectively. The power supply module 12 is removably connected to the housing cover 14 by four hold-down screws (not shown) which extend through holes 56 in the cover 14. The power supply module 12 includes a power supply plug 58 connected by conductor 60 to the module 12.

As will be explained later in greater detail the plug 58 is connected to a power plug connector 62 of the radio frequency module 54.

Figure 4:
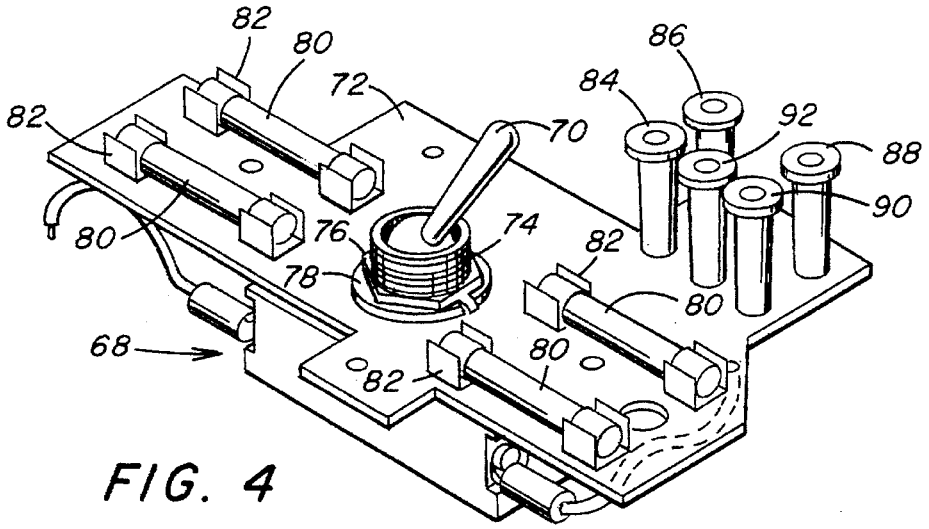
FIG. 4 is an isometric view of a toggle lever switch assembly for controlling the flow of power between the modules in the amplifier housing.
Figure 5:
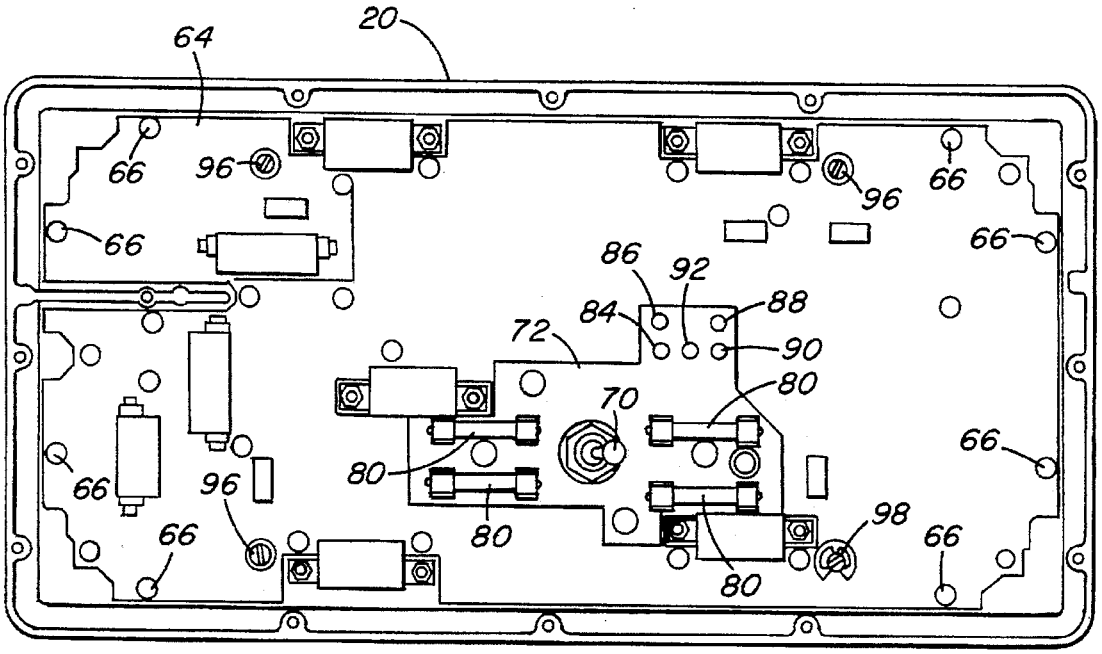
FIG. 5 is a plan view of the amplifier housing base containing a radio frequency module, illustrating the toggle lever switch assembly mounted on a PC board connected to the radio frequency module.
Figure 6:
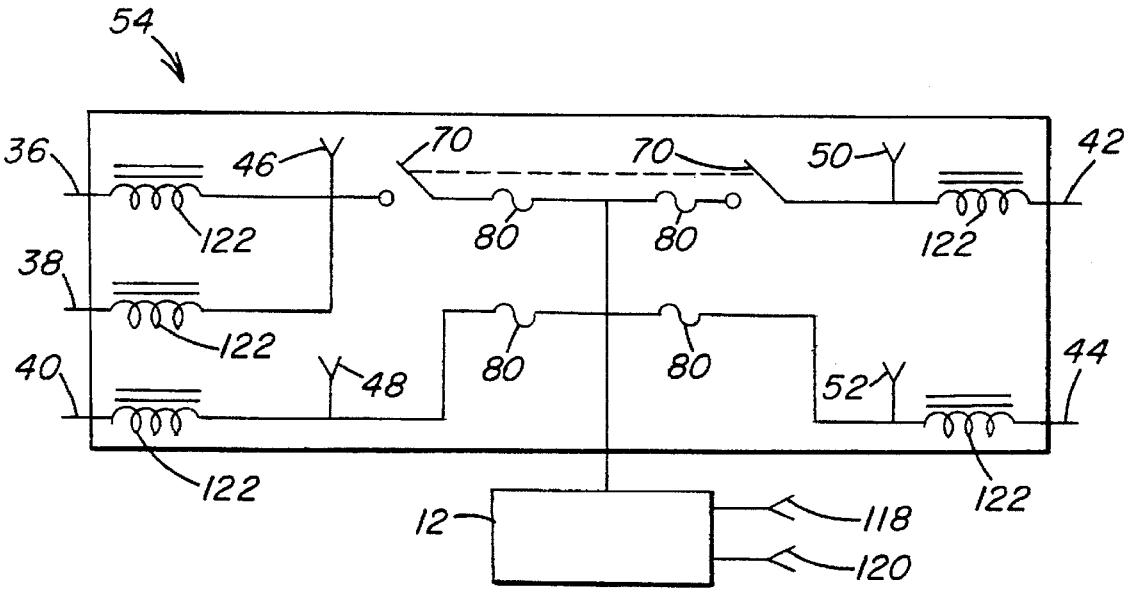
FIG. 6 is a schematic of the electrical connection between the radio frequency module and the power supply module through a bank of fuses and the toggle lever switch assembly.

The radio frequency module 54 as shown in FIG. 3 includes an assembly of the RF module power connector 62 and a PC board 64 electrically connected to the power connector 62 and mounted on the housing base 20 by a plurality of screws 66 as seen in FIG. 5. Electrically connected to the RF module power connector 62, as shown in detail in FIG. 4, is a switch assembly generally designated by the numeral 68. The switch assembly 68 includes a pivotal toggle lever 70 which controls the supply of power between the power supply module 12 and the radio frequency module 54. The toggle lever 70 is movable between a power on position and a power off position. In the power on position power is supplied from the radio frequency module 54 to the power supply module 12 as seen in FIG. 6. In the power off position of the lever 70 power is interrupted to the module 12.

As seen in FIGS. 4 and 5 a fuse board 72 is mounted on the switch assembly 68 and includes an opening for receiving a threaded shaft 74, hex nut 76, and locking ring 78 associated with the toggle lever 70. With this arrangement the toggle lever 70 is securely supported for pivotal movement between the power on and power off positions. As seen in FIG. 4 the fuse board 72 includes a plurality of fuses 80 removably retained on the board 72 by fuse clips 82. As further seen in FIGS. 4 and 5 the fuse board 72 includes a plurality of line voltage test points 84, 86, 88, and 90 and a ground test point 92. The test point 84 monitors the AC voltage at port 40 of the housing base 20. The test point 86 monitors the AC voltage at ports 36 or 38 of the housing base 20. The test point 88 monitors the AC voltage at port 42, and the test point 90 monitors the AC voltage at port 44 of the housing base 20. The ground test point 92 provides a ground reference for AC input measurements.

Figure 9:
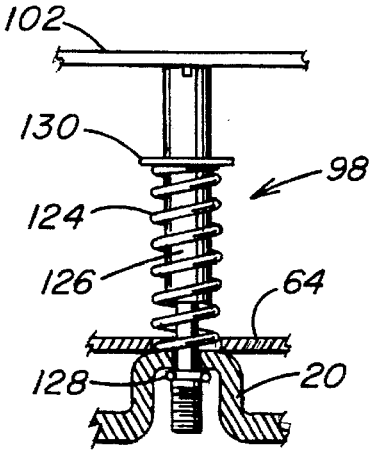
FIG. 9 is an enlarged fragmentary sectional view in side elevation of a spring actuated hold down screw for preventing movement of the toggle switch to the power on position when the electrical connections are exposed.
Figure 7:
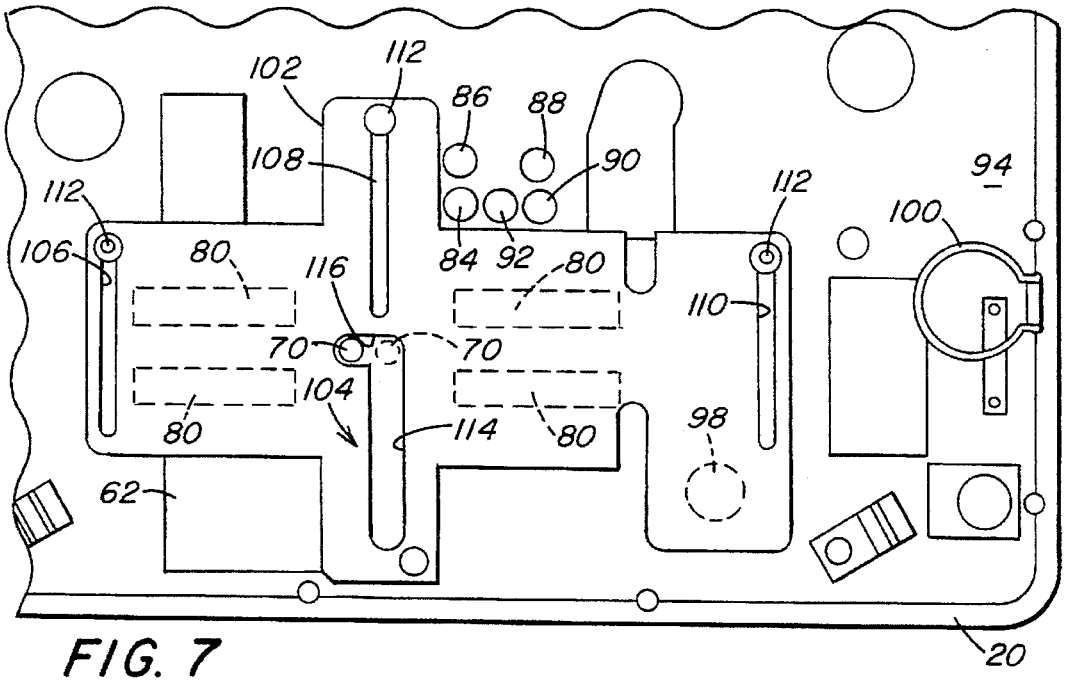
FIG. 7 is a fragmentary plan view of a slide cover plate locked in position on the PC board when the toggle switch is in a power on position to supply power to the amplifier.
Figure 8:
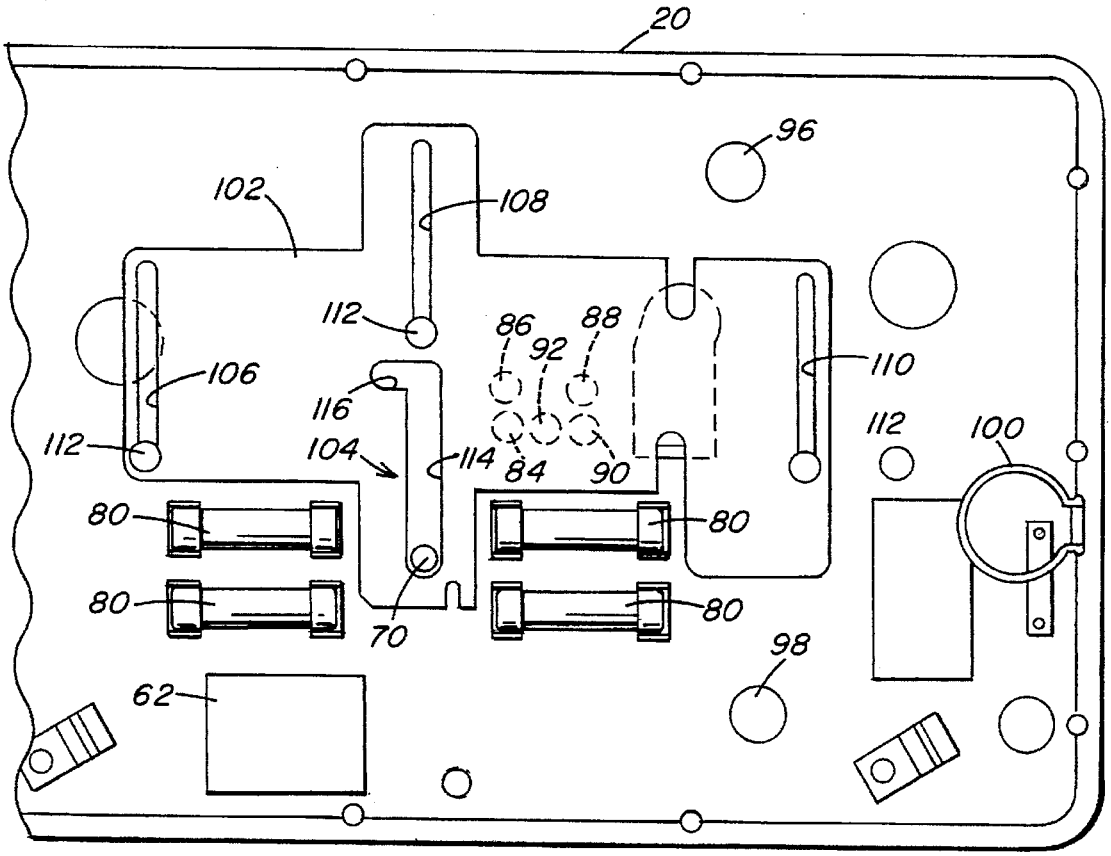
FIG. 8 is a view similar to FIG. 7, illustrating the slide cover plate moved to a position on the PC board exposing the electrical connection between the modules with the toggle switch locked in a power off position to prevent power from reaching the modules.

The fuses 80 permit AC power to enter or leave the amplifier 10 via the ports 36–44. The PC board 64 includes a plurality of electrical components that are connected to the RF module power connector 62. A module faceplate 94, shown in FIG. 3 and in greater detail in FIGS. 7 and 8, is connected to the housing base 20 by a plurality of hold-down screws 96 and a spring actuated screw 98 as illustrated in FIG. 9. Loosening the screws 96 and 98 permits removal of the radio frequency module 54 from the housing base 20.

The module cover 94 is provided with handles 100 to facilitate removal and insertion of the module 54. One of the handles 100 is shown in FIGS. 7 and 8. A second handle 100 is provided on the opposite side of the cover 94.

Slidably positioned on the module faceplate 94 in overlying relation with the fuses 80 and the connection of the power supply plug 58 to the RF power connecter 62 is a cover plate 102. In accordance with the present invention the cover plate 102 includes a L-shaped slot 104 through which the toggle lever 70 extends. The cover plate 102 is slidably mounted on the module faceplate 94 over the fuses 80 and relative to the toggle lever 70 by the provision of elongated slots 106, 108 and 110 extending in parallel alignment on the cover plate 102. Positioned in each slot 106–110 is a retaining screw 112. The screws 112 hold the cover plate 102 in place on the module faceplate 94 and also serve to provide grounding connection between the cover plate 102 and the faceplate 94.

As seen in detail in FIGS. 7 and 8, the L-shaped slot 104 of the cover plate 102 has an elongated section 114 which extends on the cover plate 102 in a direction parallel to the other slots 106–110. The slot 104 includes a second section 116 which extends perpendicular to the slot section 114 and is substantially shorter in length. The toggle lever 70 is captured within the slot 104 and is movable within the slot sections 114 and 116 between the power on and power off positions. FIG. 7 illustrates these two relative positions of the toggle lever 70.

The position shown for the lever 70 in FIG. 7 in solid is the power on position. The position of the lever shown in dashed lines in FIG. 7 is the power off position. The lever 70 is shown in the power off position in FIG. 8.

In the power off position the lever 70 is pivoted to a position within the elongated section 114 of the slot 104. When the lever 70 is in the slot section 114 and the retaining screws 112 in slots 106–110 are loosened, the cover plate 102 is slidable from the position illustrated in FIG. 7 to the position illustrated in FIG. 8 where the fuses 80 beneath the plate 102 are exposed. The plate 102 can not move to the position on the module faceplate 94 shown in FIG. 8 unless the lever 70 is in the power off position and aligned with the slot elongated section 114.

When the lever 70 is in the slot section 114 it can not be pivoted to the power on position unless the cover plate 102 is moved into overlying relation with the fuses 80. The toggle lever 70 must be positioned within the slot section 114 opposite the slot section 116 as shown in FIG. 7. Once the plate 102 is moved on the module faceplate 94 to the position shown in FIG. 7 where the fuses 80 are covered, the toggle lever 70 can be pivoted to the power on position.

Positioning the toggle lever 70 in the slot section 116 prevents the cover plate 102 from being moved to a position permitting access to the fuses 80. Access to the connection of the power supply module 12 to the RF module 54 when the amplifier 10 is under load is also prevented. The interlocking arrangement of the toggle lever 70 with the cover plate 102 provides a failsafe method to ensure that operating personnel are not exposed to hazardous voltages by preventing access to the fuses 80 and the electrical connection between the modules 12 and 54 when the switch assembly 68 is actuated to supply power between the modules.

As illustrated in FIG. 6, the AC power is sent through the RF module 54 and the fuses 80 to the interlock switch assembly 68 and the power supply module 12 where all of the DC operating voltages are developed for the RF module 54. As seen in FIG. 6, the power supply module 12 is provided with a test point 118 for AC power into the module 12 and a test point 120 for +24 VDC output. The power supply module 12 provides conversion of AC power into regulated operating voltages for the RF module 54.

The 1 Hz quasi-square wave AC power from the input cable is rooted through the RF module 54 and the fuses 80 to the power supply module 12. Thus, the fuses 80 provide the power supply module 12 with overcurrent protection.

Power is supplied to the RF module 54 from either port 36, 38 or 42 as shown in FIG. 6. Powering the amplifier 10 from port 40 or port 44 is prohibited since this would nullify the safety features provided by the interlocking arrangement of the switch assembly 68 and the cover plate 102.

When the toggle lever 70 of the switch assembly 68 is pivoted to the power on position illustrated in solid in FIG. 7, AC power at a current of 15 amps is received from cable ports 36, 38, or 42 if fuses 80 are in place for those ports. Power to operate the unit is present on the cable center conductor at each port. Power is directed out another port when the fuse for that port is installed. The AC power is separated to the internal AC power bus by RF high pass filters or chokes 122 in the RF module 54, as schematically illustrated in FIG. 6.

The power supply module 12 receives AC power from the internal power bus via the port fuses. The power supply module 12 converts the AC power into a regulated +24 VDC and sends the +24 VDC to the RF module electronics. This voltage is monitored at the +24 VDC test point 120 of the power supply module 12. Power is also provided for other accessories of the RF module 54 such as a transponder module.

When the toggle lever 70 is pivoted to a position to interrupt the power supply as illustrated by the dashed lines of the toggle lever 70 in FIG. 7 and the position of the lever 70 in FIG. 8, AC power is prevented from reaching the fuses 80 and the power supply module 12. Thus, when the toggle lever 70 is pivoted to the off position it is retained in the elongated slot section 114 and is restrained from being pivoted to the power on position. In other words, as long as the lever 70 is positioned in the elongated slot section 114, the power can not be inadvertently turned on. In the power off position operating voltages to the RF module 54 are interrupted and power is prevented from passing out any port of the RF module 54.

With the cover plate 102 interlocked with the toggle lever 70, operating personnel can not gain access to the plug-end fuses 80 when the RF module 54 is under power. The cover 102 with the toggle 70 positioned in the slot section 114 is prevented from being accidentally switched to the power on position. Furthermore, the cover plate 102 protects the connection of the power supply module to the RF module 54. The power supply plug 58 can not be reached to be disconnected from engagement with the RF module power connector 62. The only way access can be gained to the power supply plug 58 is to switch the toggle lever 70 to the power off position where it is aligned with the slot section 114 to allow the cover plate 102 to be moved from the position illustrated in FIG. 7 to the position illustrated in FIG. 8. Also, the retaining screws 112 in the slots 106 must be loosened before the cover plate 102 can be moved upwardly to expose the fuses 80 and the power supply plug 58.

An additional failsafe feature is provided by the provision of the spring actuated module hold-down screw 98 as shown in FIG. 9. The screw 98 is positioned beneath the cover plate 102 as shown in FIG. 7 when the toggle lever 70 is in the power on position. When the lever 70 is pivoted to the power off position and moved into the slot 114 permitting the cover 102 to be advanced to a position exposing the fuses 80, the screw 98 is exposed. The screw 98 is biased under the force of a spring 124 surrounding a screw shaft 126. The end of the shaft 126 extends through the PC board 64 and into engagement with the housing base 20. The extreme end of the shaft 126 is restrained from moving out of the base 20 by an enlarged shoulder 128. The spring 124 is captured between the PC board 64 and an opposite shoulder 130 on the screw shaft 126.

When the cover plate 102 is removed from overlying relation with the screw 126 the spring 124 expands to project the screw 126 above the elevation of the plate 102. When the screw 98 projects above the elevation of the plate 102, the plate can not be returned to the power on position shown in FIG. 7 until the screw is forced down against the compression of the spring to allow the plate 102 to advance over the depressed screw 98. This arrangement serves as a further safeguard in preventing inadvertent exposure of operating personnel to the fuses and the power connection between the modules when the amplifier is under load.

According to the provisions of the patent statutes, I have explained the principle, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. A safety interlock system for a telecommunications amplifier comprising, a first module for receiving electrical power from a source and transmitting the electrical power, a second module for receiving the electrical power transmitted by the first module, an electrical circuit removably connecting the first and second modules, an electrical switch positioned in said circuit to open and close said circuit and control the electrical power transmitted by said first module to said second module, a toggle lever connected to said switch for actuating said switch to open and close said circuit upon pivotal movement between power off and power on positions respectively, a cover plate movably supported in overlying relation with said circuit connecting said first and second modules, said cover plate having an elongated slot for receiving said toggle lever, said cover plate movable relative to said toggle lever positioned in said slot, spring biased means supported by a selected one of said first and second modules for restraining slidable movement of said cover plate in overlying relation with said circuit, said spring biased means movable between a depressed position beneath said cover plate and an extended position projecting above said cover plate, said spring biased means positioned in said depressed position when said toggle lever is in the power on position, said spring biased means positioned in said extended position when said toggle lever is in the power off position, said spring biased means in said extended position restraining movement of said cover plate to prevent movement of said toggle lever to the power on position, said toggle lever when pivoted in said slot to the power on position obstructing movement of said cover plate to preclude access to said circuit and prevent disconnection of said first and second modules when power is transmitted to said second module, and said toggle lever when pivoted in said slot to the power off position allowing movement of said cover plate to a position relative to said toggle lever to provide access for disconnecting said first and second modules while preventing movement of said toggle lever to the power on position.

2. A safety interlock system for a telecommunications amplifier as set forth in claim 1 in which, said first module is a radio frequency module for receiving an AC power signal combined with a radio frequency, and said second module being a power supply module for converting AC power to a regulated DC voltage to supply DC voltage for operation of said radio frequency module.

3. A safety interlock system for a telecommunications amplifier as set forth in claim 2 in which, said cover plate is slidably positioned on said radio frequency module overlying the connection of said radio frequency module to said power supply module.

4. A safety interlock system for a telecommunication amplifier as set forth in claim 1 which includes, a housing base, a module faceplate removably connected to said housing base, said first module mounted on said module faceplate, said electrical circuit mounted on a PC board, said PC board secured to said module faceplate, and said first module together with said PC board being removable from said housing base upon release of said module faceplate from connection to said housing base.

5. A safety interlock system for a telecommunications amplifier as set forth in claim 4 which includes, a fuse board mounted on said PC board, a plurality of fuses for controlling the supply of electrical power to said first module, said fuses being removably retained on said fuse board, and said toggle lever extending through an opening in said fuse board, said toggle lever supported by said fuse board for pivotal movement between the power off and power on positions.

6. A safety interlock system for a telecommunications amplifier as set forth in claim 5 in which, said cover plate is slidably positioned on said module faceplate in overlying relation with said fuses, said slot in said cover plate having a L-shaped configuration, said toggle lever extending through said L-shaped slot, said L-shaped slot having a first section for receiving said toggle lever to permit movement of said toggle lever to the power on position, and said L-shaped slot having a second section for receiving said toggle lever to prevent movement of said toggle lever to the power on position.

7. A safety interlock system for a telecommunications amplifier as set forth in claim 6 in which, said coverplate is slidable on said module faceplate to a position permitting access to said fuses when said toggle lever is positioned in said second section of said L-shaped slot corresponding to the power off position.

8. A safety interlock system for a telecommunications amplifier as set forth in claim 6 in which, said coverplate is interlocked with said toggle lever when said toggle lever is positioned in said first section of said L-shaped slot corresponding to the power on position to prevent said coverplate from being moved to said L-shaped slot second section and said fuses from being exposed.

9. A safety interlock system for a telecommunication amplifier as set forth in claims 1 which includes, a housing forming an enclosed compartment, said housing having ports for attachment to electrical cables for receiving an AC power signal combined with a radio frequency signal, a faceplate removably connected to said housing in said compartment, and said first module including a radio frequency module mounted on said faceplate for receiving an AC power signal combined with a radio frequency signal and separating the AC power signal from the radio frequency signal.

10. A safety interlock system for a telecommunications amplifier as set forth in claim 9 in which, said second module is a power supply module having a power supply plug removably electrically connected to said radio frequency module in said housing for converting AC power to a regulated DC voltage to supply DC voltage for operation of said radio frequency module.

11. A safety interlock system for a telecommunications amplifier as set forth in claim 10 in which, said toggle lever is movable between a closed position to transmit an AC power signal to said power supply module and an open position preventing the AC power signal from being received by said power supply module.

12. A safety interlock system for a telecommunications amplifier as set forth in claim 11 in which, said toggle lever when in the closed position is retained in a first position in said slot to prevent sliding movement of said cover plate to fix the position of said cover plate on said radio frequency module to prevent access to said power supply plug for completing the electrical connection between said radio frequency module and said power supply module and to prevent said power supply plug from becoming disconnected from engagement with said radio frequency module when said toggle lever is in the closed position.

13. A safety interlock system for a telecommunications amplifier as set forth in claim 11 in which, said toggle lever when in the open position is retained in a second position in said slot allowing movement of said cover plate to a position on said radio frequency module allowing access to remove the electrical connection with said power supply module.

14. A safety interlock system for a telecommunications amplifier as set forth in claim 11 in which, said toggle lever when in the first position in said slot is interlocked with said cover plate to prevent movement of said cover plate and prevent access to said spring biased means when said toggle lever is in the power on position.

15. A safety interlock system for telecommunications amplifier as set forth in claim 11 in which, said radio frequency module includes a plurality of fuses for controlling the supply of electrical power to said radio frequency module, said fuses being positioned beneath said cover plate when said toggle lever is in the closed position, and said toggle lever when in the first position in said slot is interlocked with said cover plate to prevent movement of said cover plate to prevent access to said fuses positioned below said cover plate.

16. A safety interlock system for a telecommunications amplifier as set forth in claim 10 in which, said housing includes a cover and a base, said housing cover hingedly connected to said housing base, said base having a plurality of cable input/output ports and a plurality of test point ports, said power supply module removably connected to said housing cover, and said radio frequency module removably connected to said housing base.

17. A safety interlock system for a telecommunications amplifier as set forth in claim 16 which includes, a module faceplate removably connected to said housing base, and said radio frequency module mounted on said module faceplate such that disconnection of said module faceplate from said housing base permits removal of said radio frequency module from said housing.

18. A safety interlock system for a telecommunications amplifier as set forth in claim 1 in which, said spring biased means includes a shaft member supported in said housing for vertical movement relative to said cover plate between the depressed position beneath said cover plate in the power on position and the extended position projecting above said cover plate in the power off position, and a spring surrounding said shaft member for normally exerting an upward force on said shaft member to move said shaft member from the depressed position to the extended position.

19. A safety interlock system for a telecommunications amplifier as set forth in claim 18 in which, said spring moves said shaft member to project above said cover plate when said toggle lever is in the power off position and said cover plate is moved to a position to provide access for disconnecting said first and second modules and, said shaft when projecting above said cover plate prevents movement of said toggle lever to the power on position and prevents the supply of electrical power to said first module.

20. A safety interlock system for a telecommunications amplifier as set forth in claim 18 in which, said spring when compressed moves said shaft member to the depressed position to allow said cover plate to move over said shaft member and permit movement of said toggle lever to the power on position.

* * * * *

UNITED STATES PATENT AND TRADEMARK OFFICE

CERTIFICATE OF CORRECTION

PATENT NO : 5,641,953

DATED : June 24, 1997

INVENTOR(S) : Lawrence R. Fisher

It is certified that error appears in the above-identified patent and that said Letters Patent is hereby corrected as shown below:

| | |
|---|---|
| Column 7, line 55 | after "includes" delete 'a' and insert -- an --. |
| Column 9, line 61 | after "plate" delete 'can not' and insert -- cannot --. |
| Column 11, line 34 | after "having" delete 'a' and insert -- an --. |

Signed and Sealed this

Twenty-fourth Day of March, 1998

*Attest:*

Bruce Lehman

BRUCE LEHMAN

*Attesting Officer*

*Commissioner of Patents and Trademarks*